United States Patent [19]

Lopez

[11] Patent Number: 4,819,826

[45] Date of Patent: Apr. 11, 1989

[54] TOOL FOR OPENING A CAN WITH A TOP WHICH IS EASY TO OPEN

[75] Inventor: Ricardo R. Lopez, Vigo, Spain

[73] Assignee: Envases Carnaud, S.A., Spain

[21] Appl. No.: 109,153

[22] Filed: Oct. 15, 1987

[30] Foreign Application Priority Data

Oct. 20, 1986 [ES] Spain ..... 8602679

[51] Int. Cl.[4] ..... B65D 17/34

[52] U.S. Cl. ..... 220/273; 220/274

[58] Field of Search ..... 81/3.07, 3.09, 3.15, 81/3.55, 3.47, 3.48; 220/273, 274, 275, 270

[56] References Cited

U.S. PATENT DOCUMENTS 496,175 4/1893 Waeber ..... 220/274
568,222 9/1896 Zimmerman ..... 220/274
3,381,847 5/1968 Smyth ..... 220/273
3,682,350 8/1972 Baugh et al. ..... 220/273
4,445,621 5/1984 Saunders ..... 220/273

*Primary Examiner*—Debra Meislin
*Attorney, Agent, or Firm*—Wood, Herron & Evans

[57] ABSTRACT

The invention relates to a tool for opening a can with a top which is easy to open whereby the tool is directly connected to the top. Cans of this type can be opened easily with the tool according to the invention, as once the breaking of the weak line of the top has been initiated by an incision with the pointed end of the tool, the tool is turned sideways through the point of connection with the top, after which the ringed end portion of the tool is rotated like a key for opening cans until the weakened area of the top has been completely detached.

7 Claims, 3 Drawing Sheets

FIG. 1
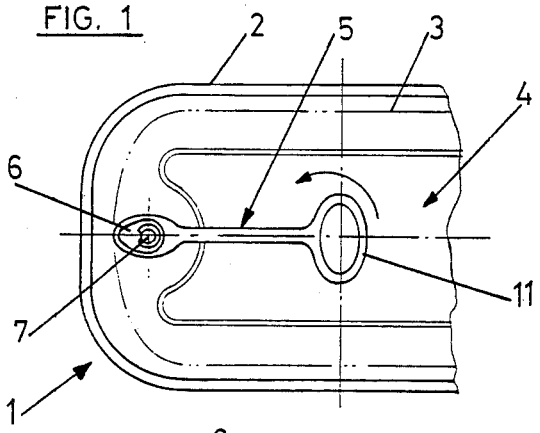
FIG. 2
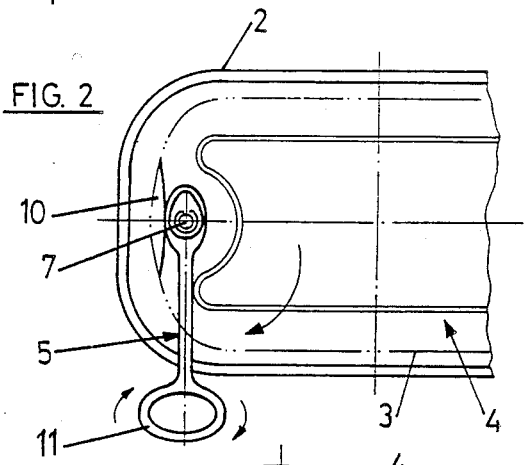
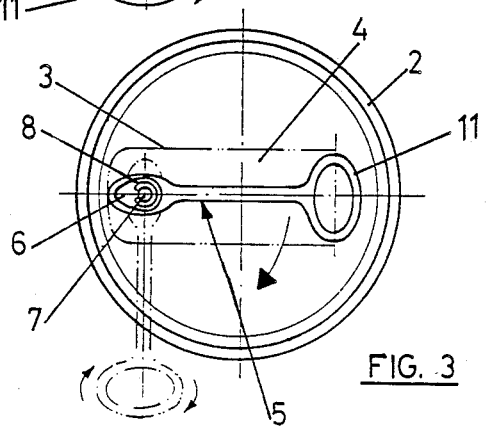
FIG. 3

FIG. 4
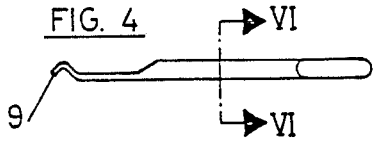
FIG. 6
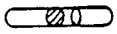
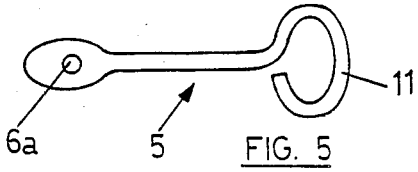
FIG. 5
FIG. 7
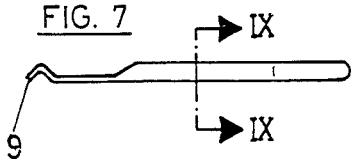
FIG. 9
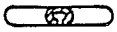
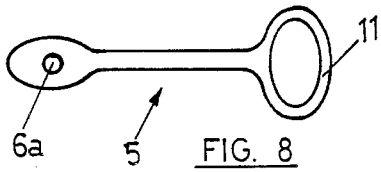
FIG. 8
FIG. 10
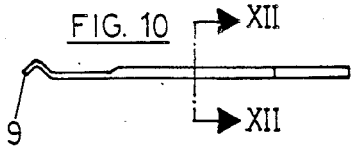
FIG. 12
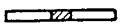
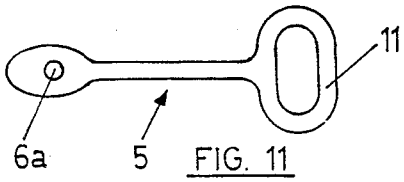
FIG. 11

TOOL FOR OPENING A CAN WITH A TOP WHICH IS EASY TO OPEN

This invention relates to a tool for opening cans with tops which are easy to open, the tool being connected directly to the top.

On cans which are easy to open, the top is provided with an end ring connected to a dished portion of the top, the ring having a shape in the end area which facilitates forming the initial break in an area of the weak line on the top and a subsequent tearing of this weakened area and the detachment of the top.

However, it must be pointed out that there is a critical area during the tearing away of the weak line on the top, where the user encounters real problems in detaching it.

The tool or key which is the subject of the invention has been designed to overcome the abovementioned problems. It is connected to the top and has a special feature whereby because of its length and construction, it can be turned about its gripping point on the top and consequently protrude to the side of the walls of the can, once the breaking of the weakened area of the top subjected to the pointed end of the tool has begun.

Consequently once the tool has been turned, a rotational force is applied to the ringed end part so that it acts as a key and a complete opening of the can is achieved by the tearing of the weakened area of the top.

According to the invention the tool can be constructed of wire or thick plate and the key always has a flat end portion which for preference is oval and in which there is a circular opening or orifice by means of which the tool is fixed to a dished portion in the top of the can and which serves as a rivet, whereby the tool can be displaced in such a way that it operates with a first lever and with the pointed free end of which is effected the breaking of the corresponding area of the weak line with which it comes into contact.

After this operation the tool is turned outwards through an angle of 90° and by rotating it as a key the weakened area of the plate is broken and completely detached.

To enable not only the construction but also the operation and use of the tool to be understood more readily a practical example of an embodiment of the invention is described below; this description is of an informative nature and is in no way restrictive as far as the invention is concerned. This is also shown in the attached drawings in which:

FIG. 1 shows a plan view of the can with the tool in an initial position;

FIG. 2 shows a view of the tool turned through 90° in relation to FIG. 1;

FIG. 3 shows the two operating positions of the tool;

FIGS. 4, 5 and 6 show views of a tool according to the invention made of wire;

FIGS. 7, 8 and 9 show views of a tool according to the invention made of thin plate.

FIGS. 10, 11 and 12 show views of tool according to the invention made of thick plate;

FIG. 13 represents a sectional view of the can and tool together in which are shown the two positions of the tool for initiating the breaking of the weak line;

FIG. 14 shows the lateral position of the tool when it is used as a key during the phase of completely detaching the weakened area of the top.

The can 1 is a can which is easy to open of the type which is sealed by means of a suitably lock-seamed top 2.

The top 2 has a weak line 3 which marks out an area 4.

The tool 5 is fixed in this area 4 by its lateral part.

This tool has a broader portion 6 at the end provided with a drill-type connection 6a by means of which the tool is fixed to a dished portion 7 of the area 4 of the top, whereby the tool in this part has for example a section 8 in the general shape of a "U" which enables it to be moved up so that its pointed end 9 breaks the area 10 of the weak line 3.

The free end of the tool is completed with a closed or semi-closed ring 11 (FIG. 5).

Once the area 10 has been broken, the tool is turned through 90° outwards on the dished portion 7 (FIG. 2) rotating or turning it as if it were a key so that the tearing and complete opening of area 4 of the top (FIG. 4) is achieved.

Three types of variants of the tool according to the material used in its construction are shown in the illustrations. Thus in FIGS. 1 to 3 which show a can of the type described, a tool is used which is illustrated in FIGS. 7 to 9 and which is formed from thin plate.

FIGS. 10 to 22 show a tool formed from thick plate whilst FIGS. 4 to 6 show a tool formed from wire.

I claim:

1. An easy opening container comprising a wall having a line of weakness therein, said weakness line defining a tear portion at least partially removable from said container wall, and a tool connected to said tear portion, said connection permitting said tool to pivot in a piercing plane generally normal to said wall, and said connection also permitting said tool to pivot in a tear off plane generally parallel to said wall, said tool comprising a piercing point located adjacent a section of said weakness line when said tool is in a storage position, said piercing point functioning to pierce said wall at said section when said tool is pivoted in said piercing plane, and a handle located within the periphery of said wall when said tool is in a storage position, said handle being of such length that it extends beyond the periphery of said wall after said tool has been pivoted to tear off position, said tool being rotatable when in said tear off position so as to roll up said tear off portion thereon after said wall has been pierced in order to open said container.

2. An easy opening container as set forth in claim 1, said handle comprising a ring section at the free end thereof, said ring section extending beyond the periphery of said wall after said tool has been pivoted to a tear off portion.

3. An easy opening container as set forth in claim 2, said handle being of rectangular cross-section.

4. An easy opening container as set forth in claim 1, said piercing point comprising a central portion which is bent downwards along the major axis of said tool so that the pressure which is applied to said wall is concentrated at said bent end.

5. An easy opening container as set forth in claim 1, said container comprising a rivet which connects said tool to said wall, said rivet cooperating with a dished portion in said wall to establish said pivot connection so that said tool can be turned in said tear off plane.

6. An easy opening container as set forth in claim 1, said tool being formed from thin plate, that portion of said tool which is connected to said wall comprising a hinge defined by a section having a general U-shape, the opening of said U-shape being directed towards said piercing point.

7. An easy opening container as set forth in claim 6, said tool comprising a reinforcing rim on the front portion of its periphery.

* * * * *